US011400464B2

(12) United States Patent
deLesdernier et al.

(10) Patent No.: US 11,400,464 B2
(45) Date of Patent: Aug. 2, 2022

(54) SPRAY NOZZLE

(71) Applicant: Bete Fog Nozzle, Inc., Greenfield, MA (US)

(72) Inventors: Daniel T. deLesdernier, Greenfield, MA (US); Matthew P. Betsold, Turners Falls, MA (US); Gary Cole, Shelburne, MA (US); Robert A. Dionne, Holyoke, MA (US)

(73) Assignee: Bete Fog Nozzle, Inc., Greenfield, MA (US)

( * ) Notice: Subject to any disclaimer, the term of this patent is extended or adjusted under 35 U.S.C. 154(b) by 49 days.

(21) Appl. No.: 16/197,640

(22) Filed: Nov. 21, 2018

(65) Prior Publication Data

US 2019/0151868 A1 May 23, 2019

Related U.S. Application Data

(60) Provisional application No. 62/589,735, filed on Nov. 22, 2017.

(51) Int. Cl.
*B05B 1/30* (2006.01)

(52) U.S. Cl.
CPC ..... *B05B 1/3033* (2013.01); *B05B 1/308* (2013.01)

(58) Field of Classification Search
CPC ..... B05B 1/3033; B05B 1/308; B05B 1/265; B05B 1/06; B05B 17/085
See application file for complete search history.

(56) References Cited

U.S. PATENT DOCUMENTS

| | | | | |
|---|---|---|---|---|
| 394,920 | A | 12/1888 | Hallowell | |
| 431,479 | A | 7/1890 | Powell | |
| 583,135 | A | 5/1897 | Wilson | |
| 1,541,946 | A | 6/1925 | Harrison | |
| 1,847,404 | A | 3/1932 | Lynch | |
| 1,903,100 | A | 3/1933 | Esterling | |
| 2,393,328 | A | 1/1946 | Mahone | |
| 2,543,996 | A | 3/1951 | Turner | |
| 2,711,929 | A * | 6/1955 | Nielsen | B05B 1/12 239/456 |
| 3,029,029 | A | 4/1962 | Webster | |

(Continued)

OTHER PUBLICATIONS

Variflo Pressure Atomizing Nozzles, Product Catalogue, 2000, 5 pages.

(Continued)

*Primary Examiner* — Steven M Cernoch
(74) *Attorney, Agent, or Firm* — McCarter & English, LLP

(57) ABSTRACT

A spray nozzle has a nozzle portion at an outlet or downstream end that includes a nozzle body defining an opening therethrough, and a movable stem or pintle at least partially within the opening of the nozzle body. The stem and nozzle body define a gap therebetween to define a fluid passageway for fluid in the nozzle to flow through the nozzle portion and out of the nozzle throughout a range of relative movement between the stem and the nozzle body. The relative movement and the size of the gap may be controllable independently of fluid pressure of fluid within the nozzle. The nozzle body and the stem may define geometries so that the flow area between the stem and the nozzle body does not increase, and may decrease, in the downstream direction. The axis of the spray may be at an angle to the nozzle.

32 Claims, 14 Drawing Sheets

(56) References Cited

U.S. PATENT DOCUMENTS

| | | | | |
|---|---|---|---|---|
| 3,344,993 | A | 10/1967 | Wilder et al. | |
| 3,346,190 | A | 10/1967 | Shepherd | |
| 3,737,106 | A | 6/1973 | Arnold et al. | |
| 3,776,470 | A | 12/1973 | Tsuchiya | |
| 3,857,363 | A | 12/1974 | Ferlito | |
| 3,982,693 | A | 9/1976 | Hulsing | |
| 4,371,115 | A * | 2/1983 | Sedlacek | B01J 8/1818 239/524 |
| 4,597,529 | A | 7/1986 | Merry | |
| 4,630,554 | A | 12/1986 | Sayler et al. | |
| 4,652,234 | A | 3/1987 | Voorheis | |
| 4,678,123 | A | 7/1987 | Klaeger | |
| 4,705,535 | A | 11/1987 | Lipp | |
| 4,728,036 | A | 3/1988 | Bennett et al. | |
| 4,773,597 | A * | 9/1988 | Dittrich | B05B 7/0466 239/405 |
| 4,784,331 | A * | 11/1988 | Sharpless | B05B 5/032 118/626 |
| 4,815,666 | A | 3/1989 | Gacka et al. | |
| 4,840,313 | A | 6/1989 | Hansen | |
| 4,909,445 | A | 3/1990 | Schoonover | |
| 5,041,246 | A | 8/1991 | Garrison | |
| 5,080,286 | A | 1/1992 | Morrison | |
| 5,115,978 | A | 5/1992 | King et al. | |
| 5,148,982 | A | 9/1992 | Ekhoff | |
| 5,148,990 | A | 9/1992 | Kah, Jr. | |
| 5,158,261 | A | 10/1992 | Morohoshi | |
| 5,232,164 | A | 8/1993 | Resch et al. | |
| 5,251,823 | A | 10/1993 | Joshi et al. | |
| 5,452,857 | A | 9/1995 | Furuse et al. | |
| 5,707,010 | A | 1/1998 | Manfre et al. | |
| 5,765,742 | A | 6/1998 | Marks | |
| 5,806,762 | A | 9/1998 | Herr et al. | |
| 6,007,001 | A | 12/1999 | Hilton | |
| 6,125,787 | A | 10/2000 | Mochizuki | |
| 6,176,702 | B1 | 1/2001 | Mohr et al. | |
| 6,401,651 | B1 | 6/2002 | Mochizuki | |
| 7,507,086 | B2 | 3/2009 | Jaulent | |
| 7,938,337 | B2 | 5/2011 | Tian | |
| 8,123,150 | B2 | 2/2012 | Khan et al. | |
| 8,341,948 | B2 | 1/2013 | Freese | |
| 8,430,346 | B2 * | 4/2013 | Michael | B05B 12/085 239/690 |
| 8,523,085 | B2 | 9/2013 | Grimm et al. | |
| 8,602,320 | B1 | 12/2013 | Sherry | |
| 8,602,329 | B2 | 12/2013 | Tian | |
| 8,662,421 | B2 | 3/2014 | Russell et al. | |
| 8,888,018 | B2 | 11/2014 | Kwok et al. | |
| 2004/0050969 | A1 | 3/2004 | Bonzer | |
| 2013/0037629 | A1 | 2/2013 | Boquet | |
| 2015/0209605 | A1 | 7/2015 | Keim | |

OTHER PUBLICATIONS

Spirax Sarco, Resources And Design Tools, 2016, available at https://beta.spiraxsarco.com/Resources-and-design-tools, Last accessed Dec. 21, 2018.

International Search Report for Application No. PCT/US2018/062183, dated Mar. 22, 2019, 5 pages.

Written Opinion for Application No. PCT/US2018/062183, dated Mar. 22, 2019, 5 pages.

* cited by examiner

SPRAY NOZZLE

CROSS REFERENCE TO RELATED APPLICATIONS

This application claims the benefit under 35 U.S.C. § 119(e) to U.S. Provisional Application No. 62/589,735, filed Nov. 22, 2017, and relates to U.S. Provisional Application No. 62/411,973, filed Oct. 24, 2016, and U.S. Provisional Application No. 62/429,442, filed Dec. 2, 2016, all of which are hereby incorporated by reference in their entireties as part of the present disclosure.

FIELD OF THE INVENTION

The present disclosure generally relates to spray nozzles, and more particularly, to spray nozzles through which the flow rate may be varied.

BACKGROUND

One requirement in certain spray nozzle applications is to vary the flow rate through the nozzle to suit process needs. For example, in a gas cooling application using evaporating water as a cooling medium, the amount of water to be injected into the hot gas may vary with the temperature and mass flow of the gas. As another example, in a mixing application, it may be necessary to vary the flow rate through the nozzle to maintain the proper or desired proportions and/or consistency of a mixture. In addition, the size of the spray droplets may affect the rate of evaporation or the rate of a chemical reaction, for example.

The ability to reduce flow rate through a nozzle is known in the art as "turndown," and may be expressed as a ratio of the maximum flow rate through the nozzle and the minimum flow rate through the nozzle in the nozzle's operating range, which is known as the "turndown ratio." Previously-known nozzles advertise a flow rate range ratio of 10:1 and are described as "high turndown" nozzle types.

One way to vary flow rate through a fixed-orifice nozzle is to vary the pressure of the supplied liquid. Air-atomizing nozzles use high-velocity air or another gas to shear the sprayed liquid, and because the shear is a result of the air velocity, not the liquid velocity, the atomization is fairly independent of the liquid flow rate. Other means include multiple or groups of nozzles where the flow is varied by shutting some of the nozzles off.

Another type of nozzle is termed a "spillback" nozzle that diverts a portion of the liquid supply away from the nozzle orifice to prevent the entire flow from entering the process. An example that describes this is U.S. Pat. No. 3,029,029. A spillback nozzle often operates by introducing the liquid through a set of angled holes into a whirl chamber. There are two exits from the chamber, one into the process, and one to a return line that diverts liquid from entering the process. To lower the liquid flow rate into the process, a valve is opened in the return line to divert a variable portion of the flow, which normally returns to a storage tank.

Spillback systems have several disadvantages. For example, spillback systems allow turndown, but the total pump flow increases with a decrease in process injection flow, leading to wasted pumping power. When the valve in the return line is opened to decrease the liquid flow going to the process, the total system flow increases. The supply pump therefore consumes more power as the process liquid requirement drops. This increased pumping power requirement at turndown results in a higher operating cost at turndown than at full process flow. Also, because the pump must be sized to meet the process flow plus the return flow, a larger and thus more expensive pump is required than is necessary for the process flow itself. Spillback systems also require return piping, an expensive high pressure control valve in the return line to regulate spillback flow, and a tank to store recirculated spillback liquid, all of which incur cost and take up space.

Spring-loaded variable orifice nozzles use a spring-loaded orifice where pressure of the liquid pressure acts against a spring to open the flow area. Examples of such nozzles are described in U.S. Pat. No. 8,123,150 and U.S. Pat. No. 5,115,978

SUMMARY

It is an object of the invention to address deficiencies of known spray nozzles. More specifically, it is an object to provide better spray control at a lower cost for systems requiring variable flow.

With fixed-orifice nozzles that vary the liquid supply pressure, because the size of the droplets depends strongly on the exit velocity, which depends, in turn, on the supply pressure, it is thus not possible to control the drop size independently of the pressure. This leads to sub-optimal process function when the system is operating off the design condition. Further, because the flow through a fixed-orifice nozzle varies with the square root of the pressure, to achieve a 10:1 flow ratio, for example, a 100:1 pressure ratio is required. In such systems, if the minimum pressure required for a nozzle to form a usable spray pattern is 40 psi, then to achieve the maximum flow, the pressure would need to be increased to 1600 psi. Such a pressure requires the use of specialty pumps and expensive heavy-wall piping. Also, the character of the spray usually changes when the pressure varies to such an extent. For example, the droplet size changes and the spray angle and spray projection also change.

Air-atomizing nozzles can achieve a relatively high turndown and may produce a fairly stable spray pattern over a range of flow rates. However, compressed air is expensive and not all processes can tolerate the introduction of air or any other gas.

Disclosed herein is spray lance technology providing independent control of the flow rate and drop size, providing, among other things, substantial energy and capital cost savings over previously-known nozzles.

Systems with multiple nozzles that can be shut off to vary flow rate are inherently more expensive due to having multiple nozzles. Moreover, such systems require expensive valves and sophisticated control algorithms that open and close valves to the various nozzles. Further, the uniformity of the liquid distribution into the process is necessarily upset when some of the nozzles are turned off. In a gas contact process such as evaporative cooling or scrubbing this can lead to areas of reduced or poor gas/liquid contact, which can lead to poor process performance.

Spillback type nozzles have serious economic disadvantages. When the valve in the return line is opened to decrease the liquid flow going to the process, the total flow to the nozzle actually increases. This means that the supply pump actually consumes more power when the process liquid requirement drops. The pump thus must be sized to supply this extra flow at the minimum process flow condition, requiring a pump several times larger, and consequently more expensive, than would otherwise be necessary.

In spring-loaded orifice nozzles, the performance of these nozzles is fixed by the characteristics of the spring and the area against which the liquid pressure acts. Accordingly, flow rate and drop size performance are not adjustable independently.

In certain embodiments of the invention, the spray nozzle permits independent control of the flow rate and drop size. In certain embodiments, the spray nozzle permits substantial energy and capital cost savings over previously-known nozzles.

In certain embodiments, a spray nozzle has a hollow body having a proximal end and a distal end that is adapted to flow fluid within the hollow body in a direction from the proximal end toward the distal end, and a nozzle portion located at the distal end of the body. The nozzle portion includes a nozzle body defining an opening therethrough, and a stem or pintle having at least a portion located within the opening of the nozzle body. The stem and/or the nozzle body are movable relative to each other so that, within a range of relative movement between them, they define a gap therebetween to define a fluid passageway permitting fluid within the hollow body to flow through the nozzle portion and out of the distal end. The relative movement and size of the gap are controllable independently of the pressure of a fluid within the hollow body. In some embodiments, the relative movement of the stem and the nozzle head is performed by one or more motors or other actuators operatively connected to the stem and/or the nozzle head. The actuator may be a manual actuator. In some embodiments, relative movement of the stem and nozzle body does not change said pressure, and/or a change of fluid pressure does not change the relative positioning of the stem and the nozzle body.

In other embodiments, a spray nozzle has a hollow body having an upstream end and a downstream end and is adapted to flow fluid within the hollow body in a downstream direction from the upstream end toward the downstream end, and a nozzle portion located at the downstream end of the body, the nozzle portion including a nozzle body defining an opening therethrough, and a stem or pintle having at least a portion located within the opening of the nozzle body. The stem and/or nozzle body are movable relative to each other so that, within a range of relative movement between the stem and the nozzle body, the nozzle body and the stem define a gap therebetween to define a fluid passageway permitting fluid within the hollow body to flow through the nozzle portion and out of the distal end. The geometries of the nozzle body and said stem define the gap so that a flow area defined between the stem and the nozzle body does not increase in the downstream direction along the gap. In some such embodiments, the flow area decreases in the downstream direction. In some embodiments, the radius of curvature of the stem and the radius of curvature of the nozzle body define a convergence point. In some embodiments, the radius of curvature of the stem is greater than, even more than twice than, the radius of curvature of the nozzle body.

In yet further embodiments, a spray nozzle has a hollow body having a proximal end and a distal end that is adapted to flow fluid within the hollow body in a direction from the proximal end toward the distal end, and a nozzle portion located at the distal end of the body. The nozzle portion includes a nozzle body defining an opening therethrough, and a stem or pintle having at least a portion located within the opening of the nozzle body. The stem and/or the nozzle body are movable relative to each other so that, within a range of relative movement between them, they define a gap therebetween to define a fluid passageway permitting fluid within the hollow body to flow through the nozzle portion and out of the distal end. The nozzle further has a movable member or rod extending within the hollow body and operatively connected to the stem and/or the nozzle body such that movement of the member within the hollow body effects the relative movement of the stem and nozzle body, which is in a direction that is at an angle to a direction of movement of the member. In some embodiments, the angle is about 90 degrees.

In some such embodiments, the member or rod includes a slot therein that extends at an angle relative to the direction of movement of the member. The direction of movement of the stem is also at an angle relative to the slot. The stem includes a portion, e.g., a pin, that engages and is slidable along said slot. Movement of said member moves the slot such that the slot engages the portion of the pin and moves the pin, and thereby the stem, in the direction of movement of the stem.

In some embodiments, a linear actuator turndown ("LATD") system includes: 1) a lance assembly (LATD lance, motor, e.g., stepper motor, and motor driver) 2) a process controller(s); and 3) a pump skid (pump, filter, valves, and piping). The system can function with stand-alone process controllers or can be integrated into a process control system. Process controllers can monitor the system operating conditions. When it is necessary to decrease the flow rate from a given operating point, the controller signals the motor to retract the stem, resulting in a reduced orifice gap between the stem and the body. As discussed herein, this smaller annular gap results in reduced flow rate and reduced drop size if supply pressure is constant. However, by simultaneously reducing the supply pressure, the disclosed nozzle maintains the original drop size at the new lower flow rate while significantly reducing pump energy consumption, and hence pump operating cost.

In some embodiments, the system: 1) decreases the orifice or gap area to decrease fluid flow when decreasing process flow; 2) maintains velocity for improved atomization; 3) decreases pump flow, reducing energy costs; and 4) uses a smaller pump and motor than previously-known systems, saving capital and operating costs. The moveable stem inside the nozzle body may create a variable-area annulus. The nozzle body or head may comprise ceramics or a ceramic insert. The stem position may be controlled by a stepper motor. Such or other motor or other actuation mechanism (including manual actuation) may be mounted to the proximal end of the spray nozzle. In some embodiments, when the inlet diameter is 0.5" and 0.6875", the motor can move the stem when the inlet pressure is 600 psi or less, and when the inlet diameter is 0.875", the motor can move the stem when the inlet pressure is 200 psi or less. Adjusting the size of the orifice gap and regulating the pump speed provides greater control of the spray with lower energy consumption than previously-known systems. The system thus reduces the pumping power required at turndown, resulting in lower operating costs without performance loss.

The system not only has lower operating costs, but also requires a lower initial investment than a spillback system, as the pump is sized or configured for the maximum process flow, only one pipe is required to supply the nozzle, and there is no need for an expensive high pressure control valve or for a tank to store recirculated "wasted" spillback liquid. In sum, savings are realized by a smaller system that consumes less energy and with greater process control.

Some exemplary uses of the system are gas cooling and/or spray drying, though the system may be used for any suitable purpose. As a person of skill in the art should understand, the system allows for online changes to suit feed or product requirements.

In some embodiments, a liquid flow is supplied to a spray nozzle from a liquid supply line at a liquid supply pressure, and the liquid supply pressure is subject to changes. The spray nozzle is configured to emit therefrom a spray pattern of liquid droplets and to control a size of the liquid droplets. The spray nozzle comprises a hollow body having an upstream end and a downstream end, and a liquid inlet in fluid communication with the hollow body and connectable in fluid communication with the liquid supply line. The liquid inlet receives the liquid flow from the supply line and introduces the liquid flow into the hollow body where the liquid flows in a downstream direction toward the downstream end. A nozzle portion is located at the downstream end of the hollow body. The nozzle portion includes a nozzle body defining an opening therethrough, and a stem having at least a portion located within the opening of the nozzle body. One or more of the stem or nozzle body is movable axially or linearly relative to the other during the liquid flow so that, within a range of relative movement between the stem and the nozzle body, the nozzle body and the stem define a gap therebetween in fluid communication with the hollow body. The gap receives the liquid flow from the hollow body and directs the liquid flow through the gap between the stem and nozzle body and out of the downstream end in the spray pattern of liquid droplets. A motor is operatively connected to at least one of the stem or nozzle body. The motor is configured to drive the relative axial or linear movement of the stem and nozzle body during the liquid flow and within the range of relative movement. The stem and nozzle body are not rotatably driven. The changes in liquid supply pressure do not change the relative position of the stem and nozzle body within the range of relative axial or linear movement. The motor driving the relative axial or linear movement of the stem and nozzle body during the liquid flow controls a size of the gap independently of the changes in the liquid supply pressure to thereby control the size of the liquid droplets in the spray pattern. In some such embodiments, the motor is a stepper motor, a linear actuator, a pneumatic cylinder, or a servo actuator.

In some embodiments, the spray nozzle is in combination with at least one of a pump or control valve, and a liquid supply line. The pump and/or control valve is configured to flow the liquid through the liquid supply line at the liquid supply pressure and into the liquid inlet. Some such embodiments further comprise at least one controller operatively connected to (i) the motor and configured to control the motor to drive the relative axial or linear movement of the stem and nozzle body during the liquid flow and within the range of relative movement, and (ii) at least one of the pump to control a speed of the pump and the liquid supply pressure, or the control valve to control a setting or positon of the control valve to control the liquid supply pressure.

In some embodiments, a method is provided for emitting a spray pattern of liquid droplets from a spray nozzle. A liquid flow is supplied to the spray nozzle from a liquid supply line at a liquid supply pressure, the liquid supply pressure is subject to changes, and the method controls a size of the liquid droplets. The method comprises:

flowing the liquid into the spray nozzle, wherein the spray nozzle comprises (i) a hollow body having an upstream end and a downstream end and a liquid inlet in fluid communication with the hollow body and connectable in fluid communication with the liquid supply line, wherein the flowing step includes receiving the liquid flow from the supply line through the liquid inlet and into the hollow body where the liquid flows in a downstream direction toward the downstream end; (ii) a nozzle portion located at the downstream end of the body, the nozzle portion including a nozzle body defining an opening therethrough, and a stem having at least a portion located within the opening of the nozzle body, wherein one or more of the stem or nozzle body is movable axially or linearly relative to the other so that, within a range of relative axial or linear movement between the stem and the nozzle body, the nozzle body and the stem define a gap therebetween in fluid communication with the hollow body, wherein the flowing step includes receiving the liquid flow into the gap between the stem and nozzle body; and (iii) a motor operatively connected to at least one of the stem or nozzle body, wherein the motor is configured to drive the relative axial or linear movement of the stem and nozzle body during the liquid flow within the range of relative movement and the stem and nozzle body are not rotatably driven;

spraying the liquid through the gap between the stem and nozzle body and out of the downstream end in the spray pattern of liquid droplets; and controlling the size of the gap independently of the changes in the liquid supply pressure by operating the motor to drive one or more of the nozzle body or the stem axially or linearly relative to the other, but not rotatably drive the stem or nozzle body, from a first position within the range to a second position within the range during the liquid flow to thereby control the size of the liquid droplets in the spray pattern.

This Summary is not exhaustive of the scope of the present aspects and embodiments. Moreover, this Summary is not intended to be limiting and should not be interpreted in that manner. Thus, while certain aspects and embodiments have been presented and/or outlined in this Summary, it should be understood that the present aspects and embodiments are not limited to the aspects and embodiments in this Summary. Indeed, other aspects and embodiments, which may be similar to and/or different from, the aspects and embodiments presented in this Summary, will be apparent from the description, illustrations and/or claims, which follow.

Although various features, attributes and advantages have been described in this Summary and/or are apparent in light thereof, it should be understood that such features, attributes and advantages are not required in all aspects and embodiments, and except where stated otherwise, need not be present in all aspects and the embodiments.

Other objects and advantages of the present invention will become apparent in view of the following detailed description of the embodiments and the accompanying drawings. It should be understood, however, that any such objects and/or advantages are not required in all aspects and embodiments.

BRIEF DESCRIPTION OF THE DRAWINGS

The foregoing and other features and advantages will be apparent from the following Detailed Description, which is to be understood not to be limiting, taken in connection with the accompanying drawings, in which.

DETAILED DESCRIPTION

Figure 1:
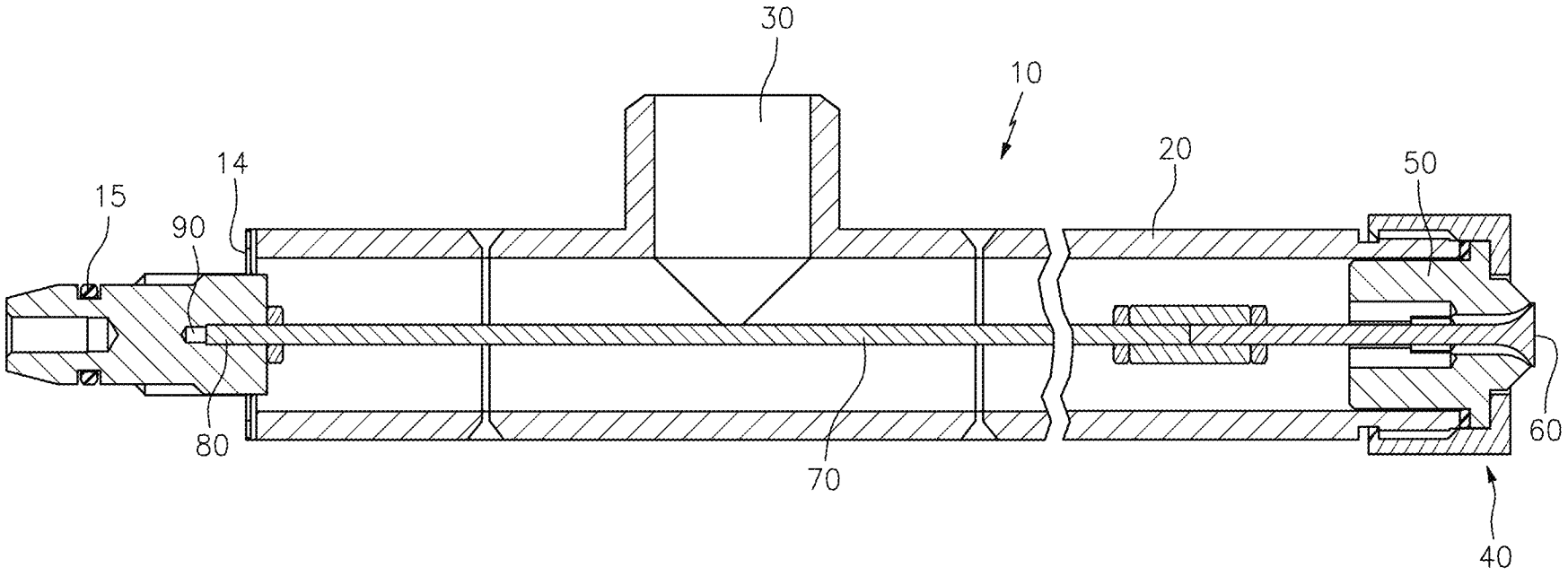
FIG. 1 is a schematic cross-sectional side view of an embodiment of a spray nozzle.

An embodiment of a spray nozzle is described with reference to FIGS. 1-3. A spray nozzle 10 has a body 20, and inlet 30 toward a proximal end of the body 20, and a nozzle portion 40 at a distal end of the body 20. The proximal end of the body 20 has a motor mount surface 14, to which a motor or actuator 55 may be mounted. The nozzle portion 40 has a nozzle body 50 and a movable stem or pintle 60. The stem 60 is movable relative to the nozzle body 50 so as to create a variable flow aperture between the stem 60 and the nozzle body 50, which varies the flow out of the nozzle 40. O-ring seal 15 seals the interior fluid passage of the nozzle from the outside environment. The o-ring seal may be elastomeric, metal, or any other appropriate material, as a person of skill in the art would understand.

The stem 60 is controlled by a stepper motor 55 or other linear actuator (not shown), which may be connected at a proximal end of the nozzle 10. Liquid enters through a connection at the inlet 30. A computer-controlled motor 55 attaches to the central rod 70 or other member which is in turn connected to the stem 60. Liquid flows between the curved surface of the pintle 60 and the nozzle body 50 and exits the nozzle portion 40 in a hollow cone spray pattern. The spray angle can be controlled by manufacturing the nozzle portion 40, e.g., the nozzle body 50 and/or stem or pintle 60, with curves that terminate at a specific angle. For example, the spray angle may be about 90-100° , but the nozzle can be configured to generate other spray angles, as should be understood by those of ordinary skill in the art. When it is necessary to decrease the flow from a given operating point, the control system signals the motor 55 to pull the rod 70 proximally (to the left in FIGS. 1-3), which closes or reduces the gap between the pintle 60 and the nozzle body 50, decreasing the flow area. Since the gap is now smaller a thinner liquid sheet forms and the supply pressure can be decreased without compromising the droplet size performance because the thinner sheet already tends to break up into smaller droplets. According to testing by the inventors, drop size is thus comparable to that of a spillback lance. As the supply pressure can be decreased by, for example, adjusting the speed of the supply pump, the power input to the system decreases when the flow decreases. The spray angle and droplet size thus can be held substantially stable during gap and/or pressure changes. In contrast to a spillback system, for example, it is necessary to size the pump and motor 55 only for the maximum process flow, which results in capital cost savings.

Figure 2:
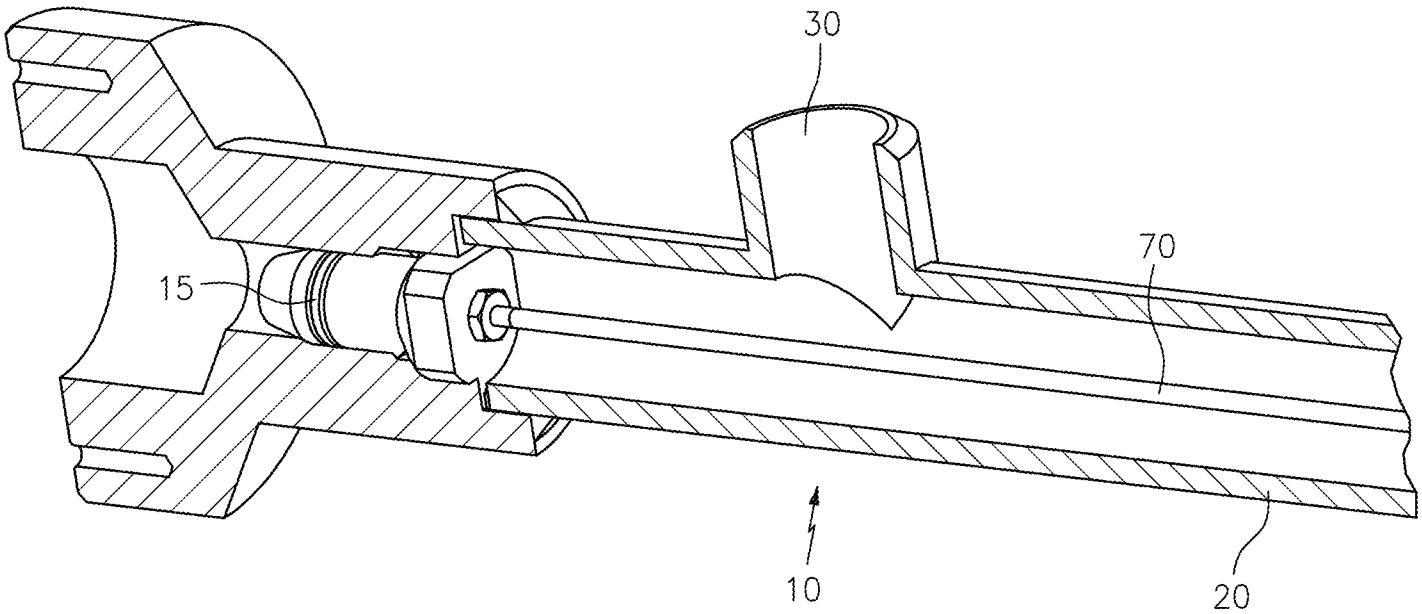
FIG. 2 is an schematic cross-sectional perspective view of the proximal end of the spray nozzle of FIG. 1.

As can be seen in FIG. 1, for example, a proximal end of the rod 70 is configured in a generally-square shaped section 80 that extends through and substantially corresponds to a square-shaped opening 90 in the proximal end of the body 20. In such embodiments, the shapes of the section 80 and opening 90 permit the rod 70 to move linearly relative to the body 20 (in proximal and distal directions) but generally prevent rotation of the rod 70 relative to the body. It should be understood that though the illustrated embodiment utilizes generally square shapes, other embodiments may use other shapes, such as but not limited to non-round shapes, to prevent such rotation.

Restraining the rod from rotating may also facilitate assembly of threaded components such as the stem 60 and body 50. A non-round feature, e.g., section 80, can assist in achieving this. For example, a threaded stem 60 can be slid into the nozzle 40 from the discharge end, and threadedly attached to the rod 70. As the rod 70 is restrained from rotation by the non-round feature, the threading can be more easily achieved. As the rod is restrained from rotation, attachment of a motor 55 is also made easier. Various other mechanical restraint mechanims may also be implemented, as should be understood by those of ordinary skill in the art.

It should be noted that though the illustrated embodiment depicts the stem 60 being moved, in other embodiments the nozzle body 50 is moved to vary the gap/aperture size, and in yet other embodiments both the stem 60 and the nozzle body 50 are moved. Thus, the resulting relative movement of the stem 60 and the nozzle body 50 adjust the gap. In some embodiments one motor or actuator 55 moves the stem 60 and the nozzle body 50. In other embodiments, multiple motors or actuators 55 are utilized.

It should also be noted that, in order to reduce wear of components, e.g., the stem 60 and nozzle body 50 that are subject to the highest flow velocities, components may be made of erosion-resistant materials, e.g., hardened stainless steel, Tungsten carbide, or ceramics. Joining of these materials may be accomplished by threading, brazing, welding, shrink fitting or any other suitable joining techniques as should be appreciated by those of ordinary skill in the art.

Figure 3:
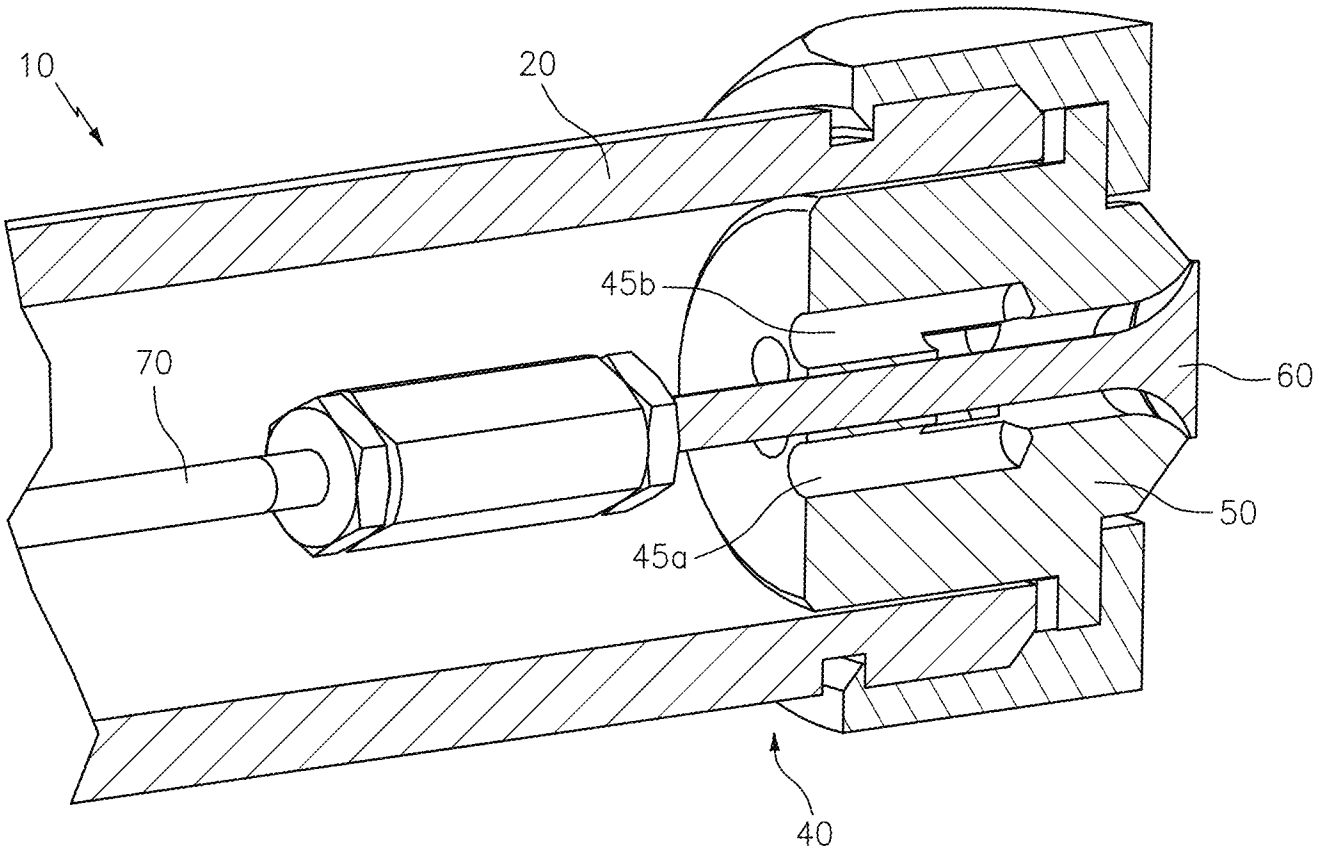
FIG. 3 is an schematic cross-sectional perspective view of the distal end of the spray nozzle of FIG. 1.
Figure 4B:
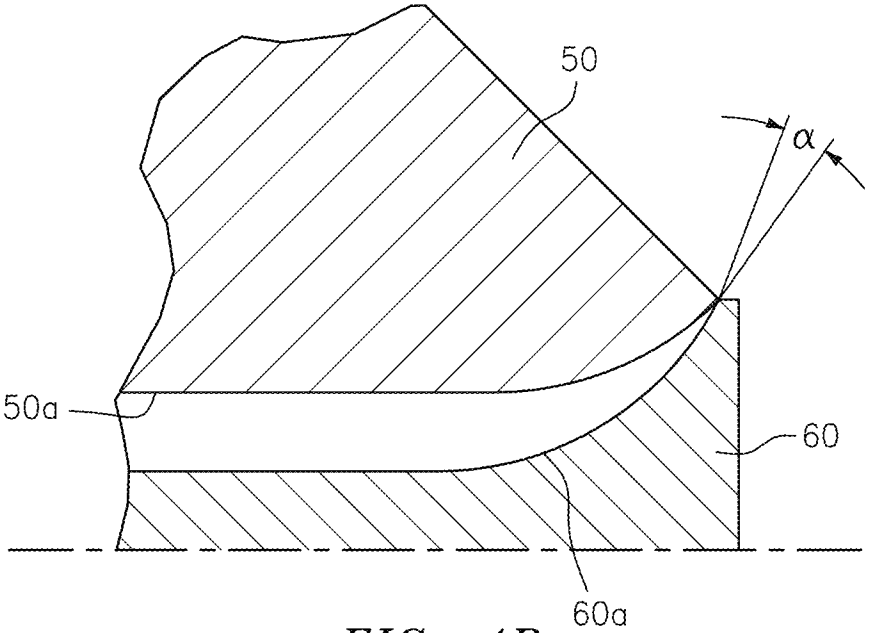
FIG. 4B is an enlarged view of a portion of FIG. 4A.
Figure 4A:
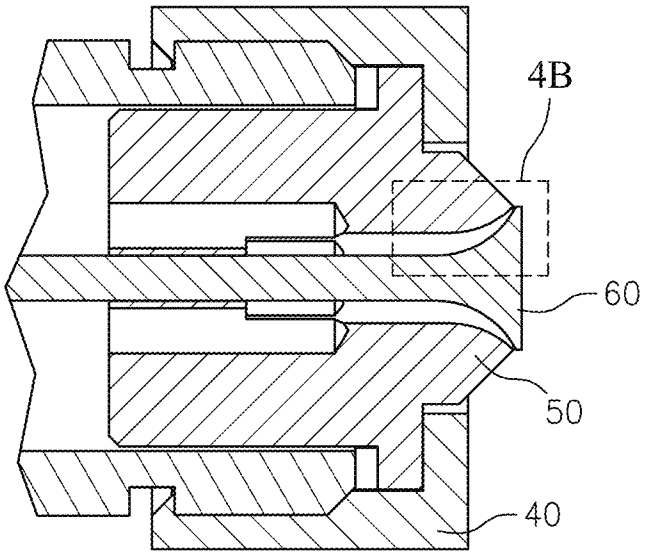
FIG. 4A is a schematic view of geometry of the nozzle body and stem of an embodiment of a spray nozzle.

As can be seen in FIG. 3, the illustrated embodiment uses feed holes 45*a*, 45*b* to feed liquid through the nozzle portion 40. However, other embodiments may utilize passages of other shapes, as should be recognized by those of ordinary skill in the art. In yet other embodiments, guide vanes or some other suitable means, either currently known or later developed, may be used, as should be appreciated by those of ordinary skill in the art.

In certain embodiments, the shapes and/curvatures of the flow surfaces of the body 50 and the stem 60 are selected so that the flow area through the nozzle portion 40, e.g., along the passageway between the stem 60 and the nozzle body 50, does not increase or decrease in the downstream direction. As the radius of the flow passage increases in the downstream direction due to the increasing radius of the stem 60, the area of the flow annulus around the stem would nominally increase. This would adversely decrease the velocity of the exiting liquid, meaning the velocity of the liquid exiting the nozzle will not be maximum, and this would diminish drop size performance. To address this, in various embodiments the curves of the stem 60 and the nozzle body 50 are selected so as to converge so that an increase in area resulting from the expanding radius of the pintle 60 does not cause an increase in flow area. In some embodiments the radius of the curve defining the termination angle $\alpha$ ("interference angle") of about 5-10°. It should be understood that the termination angle a also affects the spray angle, and the termination angle $\alpha$ may be selected so as to provide a desired spray angle profile.

Other embodiments have non-circular flow area profiles. However, it should be understood that many different profiles and geometries may be used so that the flow area does not increase, or even decreases, in the downstream direction. It is noted that, in practice, the ratio of the radii of the curves is limited so that stem diameter does not decrease to zero.

An advantage of certain embodiments of the invention is that they provide the ability to control the flow rate and drop size independently. This is achievable, at least in part, because the flow gap can be controlled independently of the flow pressure. The control over the gap size is achieved by movement of the stem 60 relative to the nozzle body 50. This can be achieved, for example, by moving the rod 70 axially, such as by using a stepper motor 55, linear actuator, pneumatic cylinder, servo actuator, or, in cases where continuous control is not necessary, manual adjustment. However, it should be understood that the movement of the stem 60 may be controlled by any suitable means, whether currently known or later developed.

On the other hand, variation in pressure may be separately achieved, such as by pump speed controls, one or more control valves, or other suitable means that are currently known or later developed. Again, manual control of pressure is possible. The system can be configured to accommodate, for example, flows from 15-850 L/min (4-225 gallons per minute (gpm), pressures from 14-41 bar (100-800 psi), and/or include nozzle inlet diameters from 0.25 inches to 2 inches. The system can be configured to operate in high temperature environments by selection and use of appropriate materials for operating conditions, as one of ordinary skill in the art should understand. The system can be configured as an inline/linear, or a right angle configuration, or any other desired or suitable configuration as should be appreciated by one of ordinary skill in the art.

Figure 5:
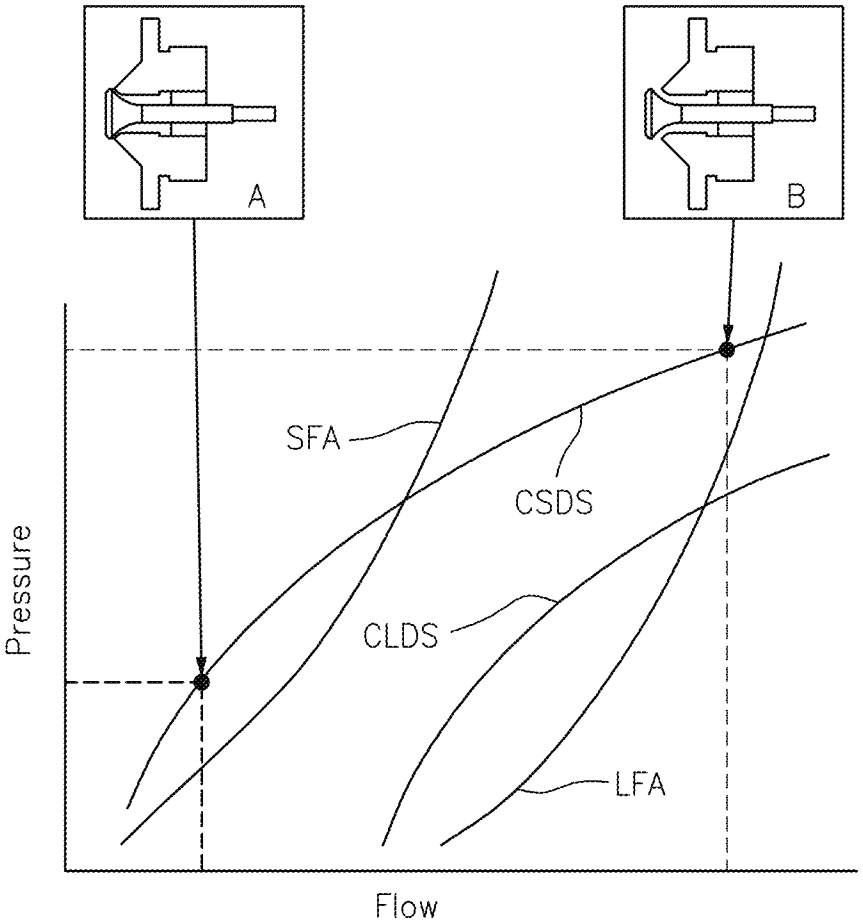
FIG. 5 is a flow chart for an embodiment of a spray nozzle.

Such embodiments allow control of the flow system when the operating spray characteristics of the nozzle 40 are known, e.g., by testing and measurement of the nozzle under operating conditions. The flow characteristics of an exemplary embodiment of a spray nozzle are shown in FIG. 5. The curves relate K-factor (nozzle opening), pressure, and drop size. The resulting operating map allows for programming of a control system. This system may then be controlled for desired drop size/flow characteristics. By way of example, if one desires the drop size to remain constant over a range of flow rates, this can be achieved by selecting a flow opening, i.e., the position of the stem 60 relative to the nozzle body 50, that achieves constant drop size at desired flow rate using a selected pressure. For example, FIG. 5 shows, for that spray nozzle embodiment, how the flow can be varied along a line of constant drop size by varying the K-factor (by varying the annulus gap, e.g., a 0.25" inlet can have a K factor range of $0.13<K<5.9$) and the pressure. In FIG. 5, the curve labelled SFA denotes small flow area, the curve labelled CSDS denotes constant small drop size, the curve labelled LFA denotes large flow area, and the curve labelled CLDS denotes constant large drop size.

When decreasing the flow rate, for example, the pressure and flow area can be reduced to maintain constant or substantially constant drop size represented by a curve. Conversely, for large flow rates, higher pressure is required to atomize, yet the system can maintain the desired drop size. For example, operating point A in FIG. 5 denotes relatively "small" process flow providing a "small" drop size in which the annular gap is reduced to provide a "small" flow area ("small" in the context of the operating range(s) of the system for such parameters) a "low" pressure is used, e.g., achieved via a "low" pump speed. Operating point B in FIG. 5 denotes relatively large process flow in which the annular gap and thus flow area is increased. To maintain drop size, higher pressure is used, e.g., via higher pump speed.

As should be understood, drop size depends on the K-factor (of the gap) and pressure. Therefore, by changing the gap, one can change the droplet size. At lower pressures and higher K-factors, droplet sizes are generally larger, whereas at higher pressures and lower K-factors, the droplet sizes are generally smaller. Droplet size can be increased or decreased by manipulation of either the K-factor or the pressure, or by manipulation of both the K-factor and the pressure. For example, if the system is at operating point B and it is desired to increase drop size, the pressure can be decreased, e.g., to the pressure that is designated by curve CLDS.

The inventors have found that certain embodiments can achieve a turndown capability of greater than 12:1, surpassing the turndown ratio of previously-known nozzles. The maximum flow at a given pressure is reached when the annulus gap is open so wide that the flow area at the exit between the stem 60 and body 50 is larger than the area between the body 50 and stem 60 at the inlet. At this point the spray is not atomized because a large amount of energy is lost in turbulence inside the nozzle. The minimum flow is reached when the two parts are so close together that small surface imperfections disrupt flow, and create streaks and voids in the spray. The minimum gap can be decreased by polishing of the two surfaces to reduce or remove surface imperfections. Thus, the turndown ratio is limited by the physical characteristics of the components, rather than the ability to control the operating parameters of the nozzle 40.

In some embodiments, the nozzle 40 may be combined with a computer control system to control the flow characteristics. The computer system may be programmed with the operating characteristics of the spray system. The system may then, based on the operating characteristics, provide the desired flow rate and drop size, independently, e.g., by independently controlling the flow gap and the pressure. Further embodiments may include a computer feedback loop that monitors a process variable of interest, such as temperature, and adjusts both the opening of the nozzle and the supply pressure to maintain the required droplet size and flow rate according to the operating characteristics of the nozzle 40.

In certain embodiments, the concentricity of the stem 60 with the nozzle body 50 within is maintained so as to achieve a more uniform spray distribution. The greater the deviation from concentricity, generally, the greater the non-uniformity of the spray distribution because the the gap between the stem 60 and the nozzle body 50 varies around the circumference of the nozzle 40. Concentricity may be achieved by maintaining tight tolerances on the outside diameter of the stem 60 and the bore in the nozzle body 50 through which it passes. Tolerances of within 0.001" have been found to obtain acceptable spray uniformity, although some embodiments perform acceptably at greater tolerances. However, as should be understood by those of ordinary skill in the art, any suitable mechanism may be used to center the stem 60, which is currently known or later developed.

Figure 6C:
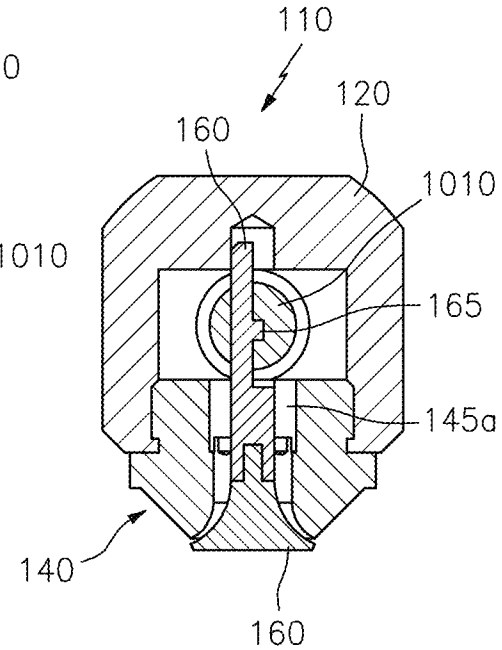
FIG. 6C is a schematic cross-sectional view of the spray nozzle of FIG. 6B taken along the section line 6C.
Figure 6A:
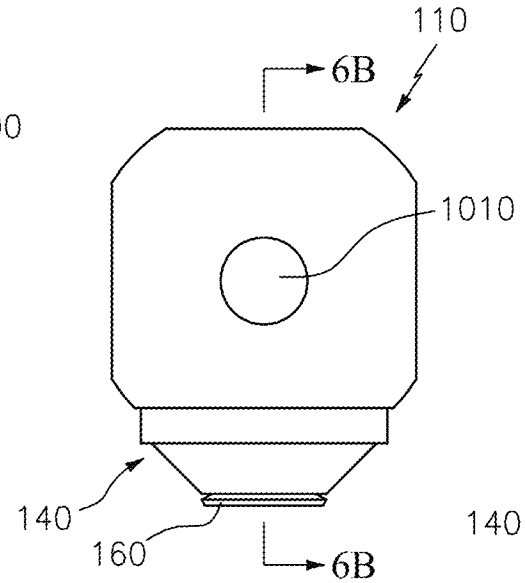
FIG. 6A is a schematic end view of the distal end of an embodiment of a spray nozzle.
Figure 6B:
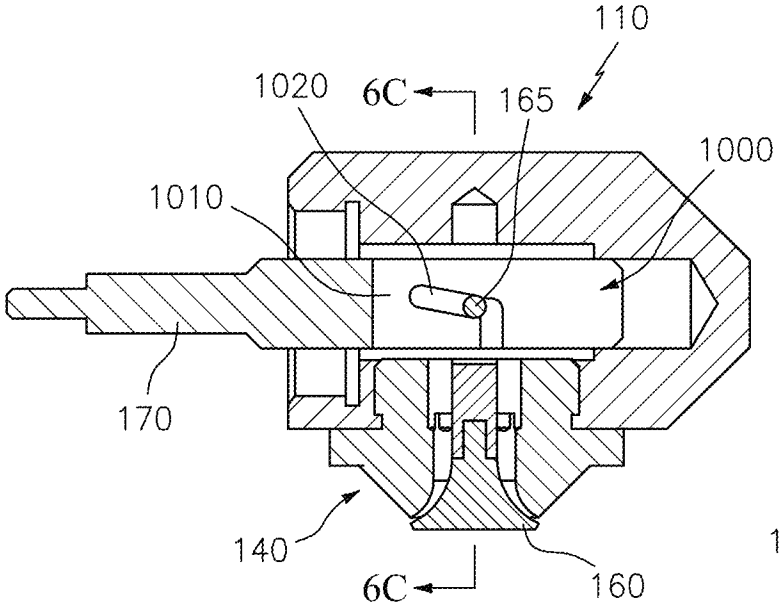
FIG. 6B is a schematic cross-sectional side view of the spray nozzle of FIG. 6A taken along the section line 6B.

Another embodiment of a spray nozzle 110 is shown in FIGS. 6A-6C. The nozzle 110 is similar in certain respects to the nozzle 10 described above with reference to FIGS. 1-3, 4A and 4B, and therefore like reference numerals preceded by the numeral "1" are used to indicate like elements. In nozzle 110, nozzle portion 140 is oriented at an (non-zero) angle to the body 120 so that the axis of the spray cone is at an angle to the axis of the body 20. Such embodiments may be useful where the nozzle must be inserted from the side of a pipe but must spray at an angle to the direction of flow in the pipe.

To achieve a spray cone oriented at a non-zero angle to the axis of the body 20, the actuation motion of the rod is converted to motion in a different or angled direction. In nozzle 110, a sliding block assembly 1000 is used. Sliding block 1000 includes a block 1010 having a slot or guideway 1020 therein. In this particular embodiment, the slot 1020 is angled with respect to the axis of the rod 170. Stem 160, which is oriented at an (non-zero) angle relative to the rod 170 includes a pin or other portion 165 located so as to engage and be slidable within slot 1020.

In operation, as the rod 170 is moved within the body 120, here axially, the block 1010 is correspondingly translated. Upon such movement of the block 1010, the angled surfaces of the slot 1020 exert an force on the pin 165 at an angle to the rod 170, causing the stem 160 to move at that angle to the rod 170. This movement is achieved because the movement of the rod 170 is constrained to particular directions by the body 120 (left or right in the Figures), and the movement of the stem 160 is constrained to particular directions within the nozzle portion 140 (up and down in the Figures). Accordingly, the movement of the rod 170 causes the stem 160 to open/close the nozzle flow area in a direction at an angle to the rod 170 and the nozzle 110 as a whole. In the illustrated embodiment, the movement of the stem is at a right angle to the rod 170 and the body 120. However, as those skilled in the art should comprehend, the nozzle 110 may be constructed so as to move the stem 160 at any desired angle and direction.

In the illustrated embodiment, no backlash correction is necessary. This is because the pressure of the liquid always loads the mechanism in the same direction (here, toward the outlet of the nozzle), so there is no backlash. However, while the illustrated sliding block assembly provides this feature, and is also simple, robust, and provides high mechanical advantage to overcome hydraulic and friction forces in the nozzle, it should be understood that the inventors contemplate other suitable mechanisms to translate direction of force/movement in nozzles may be used, whether currently known or later developed.

Figure 7A:
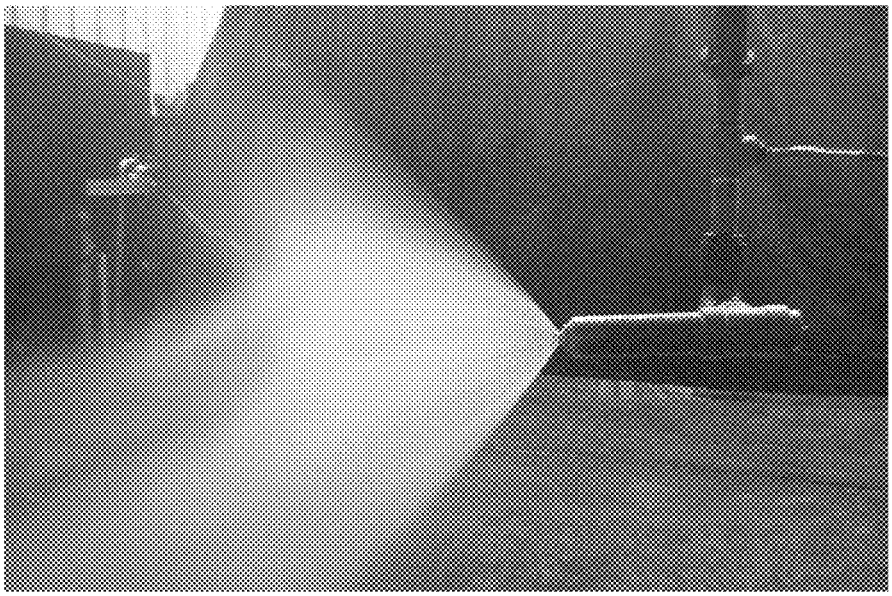
FIG. 7A shows an embodiment of a spray nozzle operating at a reduced gap and/or pressure.
Figure 7B:
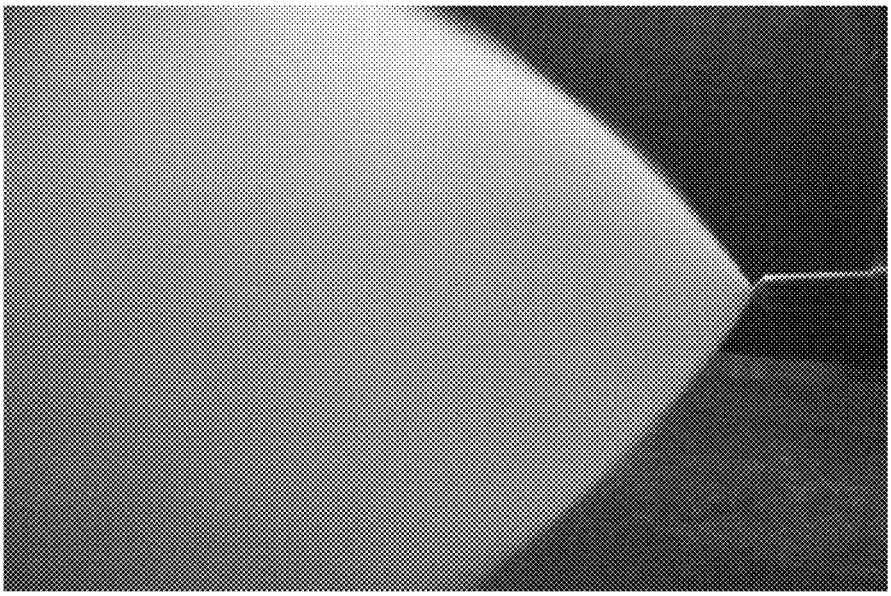
FIG. 7B shows an embodiment of a spray nozzle operating at maximum gap.

A spray nozzle in operation is shown in FIGS. 7A and 7B. FIG. 7B depicts the nozzle operating at a relatively large gap (flow orifice size) and/or high pressure and thus relatively high flow (within the operating range of the system). FIG. 7A depicts the nozzle operating at a smaller gap and/or lower pressure and thus relatively low flow. As can be seen by comparing FIGS. 7A and 7B, the system can maintain relatively constant spray angle and drop size (about 90-100°) at different gaps, flows, and/or pressures.

Figure 8:
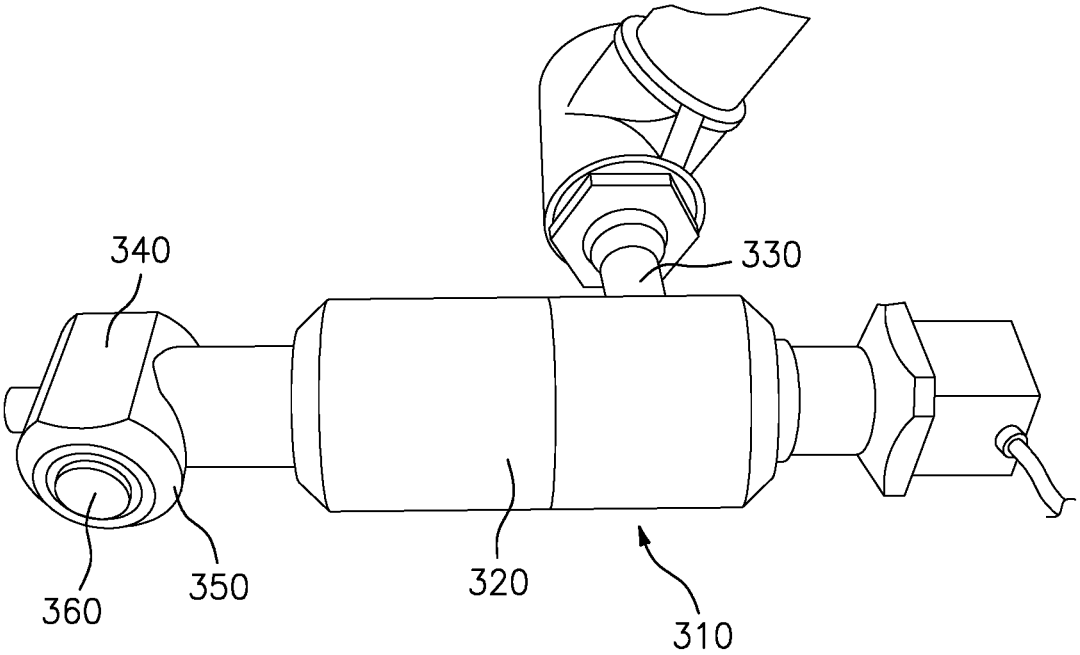
FIG. 8 shows an embodiment of a spray nozzle having a right-angle head and a sliding block mechanism.

Another embodiment of a spray nozzle 310 is shown in FIG. 8, having a right-angle head that has a sliding block mechanism (as does the embodiment shown in FIGS. 6A-6B). The nozzle 310 is similar in certain respects to the nozzle 110 described above with reference to FIGS. 6A-6C, and therefore like reference numerals preceded by the numeral "3" are used to indicate like elements. Spray nozzle 310 has a body 320, an inlet 330, and a nozzle portion 340 at an outlet end of the body 320. The nozzle portion 340 has a nozzle body 350 and a moveable stem or pintle 360. The stem 360 is moveable relative to the nozzle body 350 to control flow out of the nozzle 340.

Figure 9:
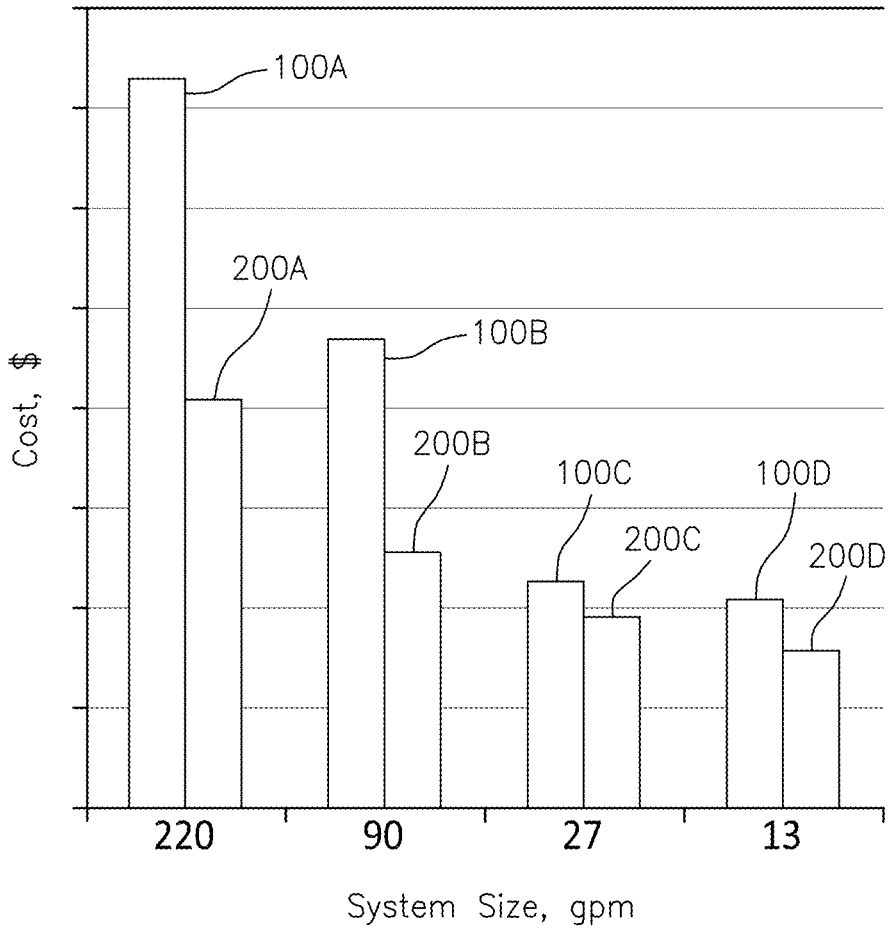
FIG. 9 is a graph showing the costs of spillback systems versus the cost of systems disclosed herein at various system sizes.

FIG. 9 is a graph showing comparative costs of a previously-known spillback systems and exemplary embodiments of systems disclosed herein at system sizes of 220, 90, 27, and 13 gpm, wherein each system includes two pumps and controls. Costs 100A, 100B, 100C, and 100D denote the costs for the spillback systems, and costs 200A, 200B, 200C, and 200D denote the costs for exemplary embodiments of systems disclosed herein. As FIG. 9 shows, the cost for the latter is significantly lower for all system sizes compared. FIG. 9 also shows that cost savings increase as system size increases.

Figure 10:
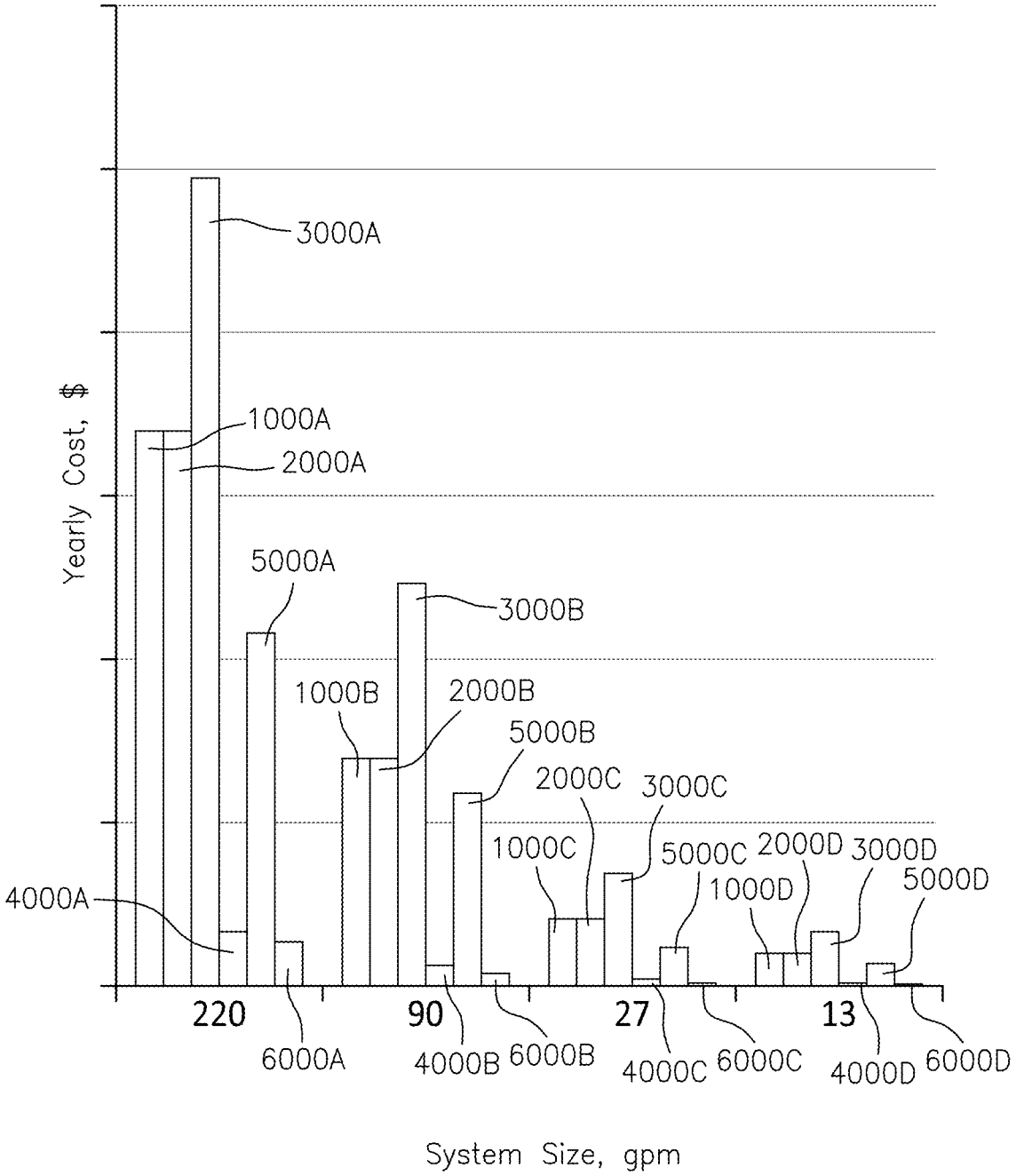
FIG. 10 is a graph showing the operating costs of spillback systems versus the operating costs of systems disclosed herein at various system sizes and under varying flow and pressure conditions.

FIG. 10 is a further graph showing comparative yearly costs of previously-known spillback systems versus exemplary embodiments of systems disclosed herein at system sizes of 220, 90, 27, and 13 gpm, wherein each system includes two pumps and controls. Costs 1000A, 1000B, 1000C, and 1000D denote the operating costs of spillback systems, and costs 2000A, 2000B, 2000C, and 200D denote the operating costs of LATD systems, under the same pressure and full flow conditions. As FIG. 10 shows, under such conditions, there is no substantial difference in operating costs between the spillback and LATD systems. Costs 3000A, 3000 B, 3000C, and 3000D denote the operating costs of spillback, and costs 4000A, 4000B, 4000C, and 4000D denote the operating costs of LATD systems, under reduced flow (turndown) conditions. As FIG. 10 shows, the costs of operating spillback systems is drastically greater than the cost of operating LATD systems under turndown conditions of reduced flow, which costs increase in spillback systems as compared to full flow conditions, showing the increased efficiency capabilities of the LATD systems. Costs 5000A, 5000B, 5000C, and 5000D denote the operating costs of spillback, and costs 6000A, 6000B, 6000C, and 6000D denote the operating costs of LATD systems, under reduced flow (turndown) and pressure conditions. As FIG. 10 shows, the costs of operating spillback systems is much greater than the costs of operating LATD systems under such conditions of reduced pressure.

Figure 11A:
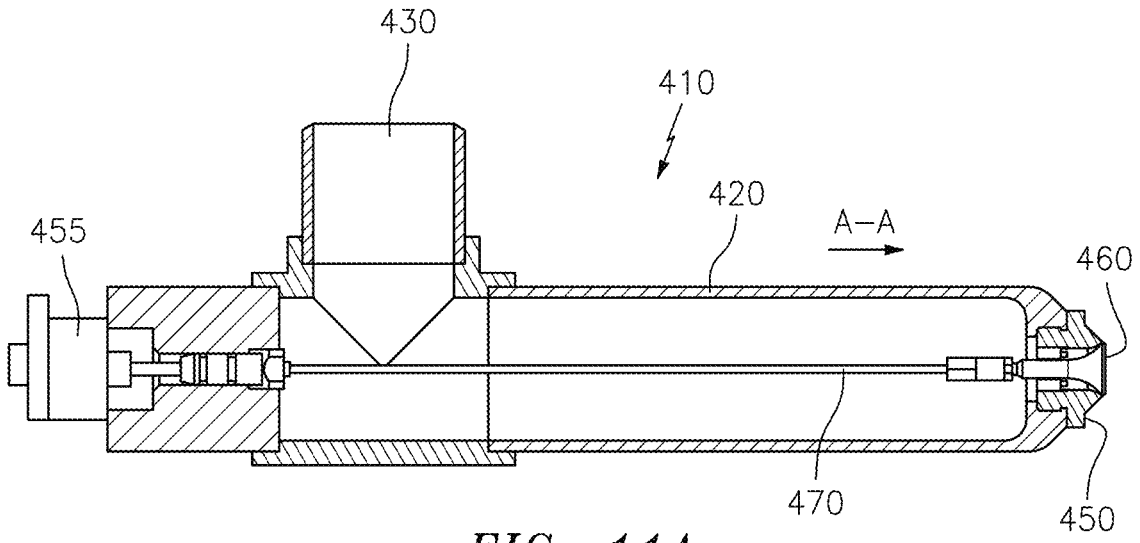
FIG. 11A shows a schematic cross-sectional side view of an embodiment of a spray nozzle.
Figure 11B:
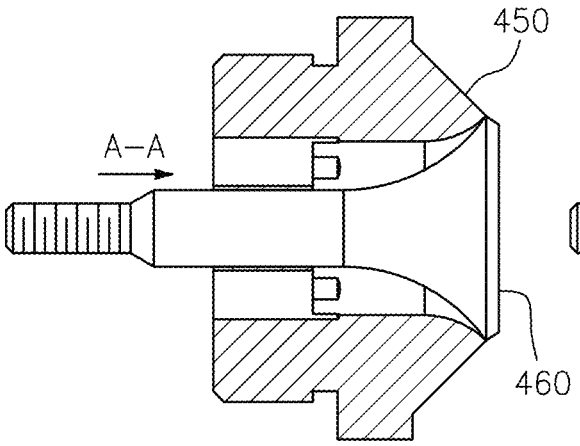
FIG. 11B shows an enlarged view of the end of the nozzle of FIG. 11A, in which the stem is in a nearly closed position.
Figure 11C:
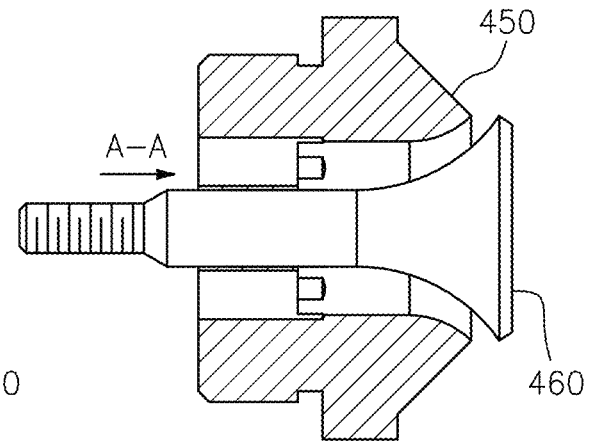
FIG. 11C shows an enlarged view of the end of the nozzle of FIG. 11A, in which the stem is in a more open position compared to that shown in FIG. 11B.

Another embodiment of a spray nozzle 410 is shown in FIGS. 11A-11C. The nozzle 410 is similar in certain respects to the nozzle 10 described above with reference to FIGS. 1-3, 4A and 4B, and therefore like reference numerals preceded by the numeral "4" are used to indicate like elements. FIG. 11A shows a spray lance with an inlet 430, a nozzle body 450, and a stem 460. Fluid flows from the inlet 430 in the direction of line A-A, towards the nozzle body 450 and stem 460. FIG. 11B shows a close-up view of the nozzle body 450 and stem 460 in a first position, in which the stem 460 is nearly closed, providing minimal flow in the direction of line A-A. FIG. 11C shows a close-up view of the nozzle body 450 and stem 460 in a second position C, in which the stem 460 is more open for increased flow in the direction of line A-A.

Figure 12A:
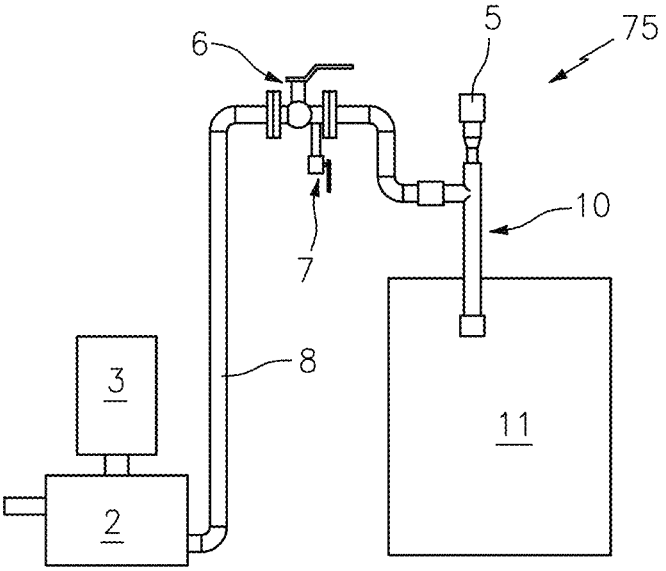
FIG. 12A schematically shows an arrangement of a nozzle system.

FIG. 12A schematically shows a spray system 75 including a spray nozzle 10. A motor 3 drives a pump 2 that pumps fluid from a fluid source (not shown) through supply line 8 to the LATD spray nozzle 10. The spray nozzle 10 sprays fluid into a process vessel 11. The system 75 has a manual shutoff valve 6 and a bleed valve 7 between the pump 2 and the spray nozzle 10. The control system 5 controls the operation of the spray nozzle 10, e.g., as described herein.

Figure 12B:
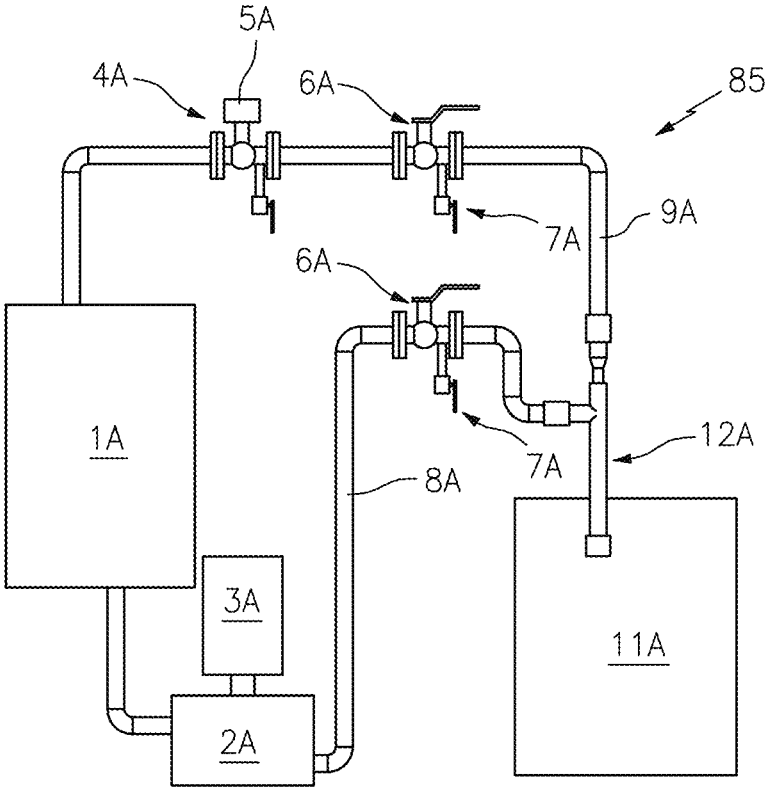
FIG. 12B (PRIOR ART)
FIG. 12B schematically shows an arrangement of a previously-known system.

FIG. 12B schematically shows a spray system 85 of a previously-known spillback system. The spillback system 85 has a motor 3A that drives a pump 2A which pumps fluid through supply line 8A to a spillback lance 12A. The spillback lance 12A sprays into a process vessel 11A. There is a manual shutoff valve 6A and a bleed valve 7A between the pump 2A and the spillback lance 12A. However, unlike the system of FIG. 12A, the spillback system 85 has a reservoir or storage tank 1A connected to the pump 2A. A spillback return line 9A is connected to the spillback lance 12A to return/recirculated spillback fluid to the tank 1A, e.g., the portion of the pumped fluid diverted away from lance 12A to provide the desired, i.e, reduced spray volume through the lance 12A. A manual shutoff valve 6A and bleed valve 7A are also located in the return line 9A. To control the amount of spillback to the tank 1A, a spillback valve 4A is controlled by a control system 5A, which in effect controls the operation of the spillback lance 12A. That is, the spillback valve 4A is opened or closed to increase or decrease spillback and thereby control the spray volume through the lance 12A. Thus, the higher the proportion of pumped fluid that spillbacks to the tank 1A relative to the spray volume, the greater the "wasted" energy expended pumping the fluid.

The nozzles described herein can be used to retrofit spillback systems. For example, by replacing a spillback lance 12A with a nozzle 10 (or other nozzles disclosed herein), a user can reduce the amount of pumping power required, e.g., only the amount of fluid needed for the spray volume need be pumped, and decrease space needed because return piping 9A and a reservoir tank 1A are no longer required, as should be appreciated by a person of ordinary skill in the art.

Figure 13:
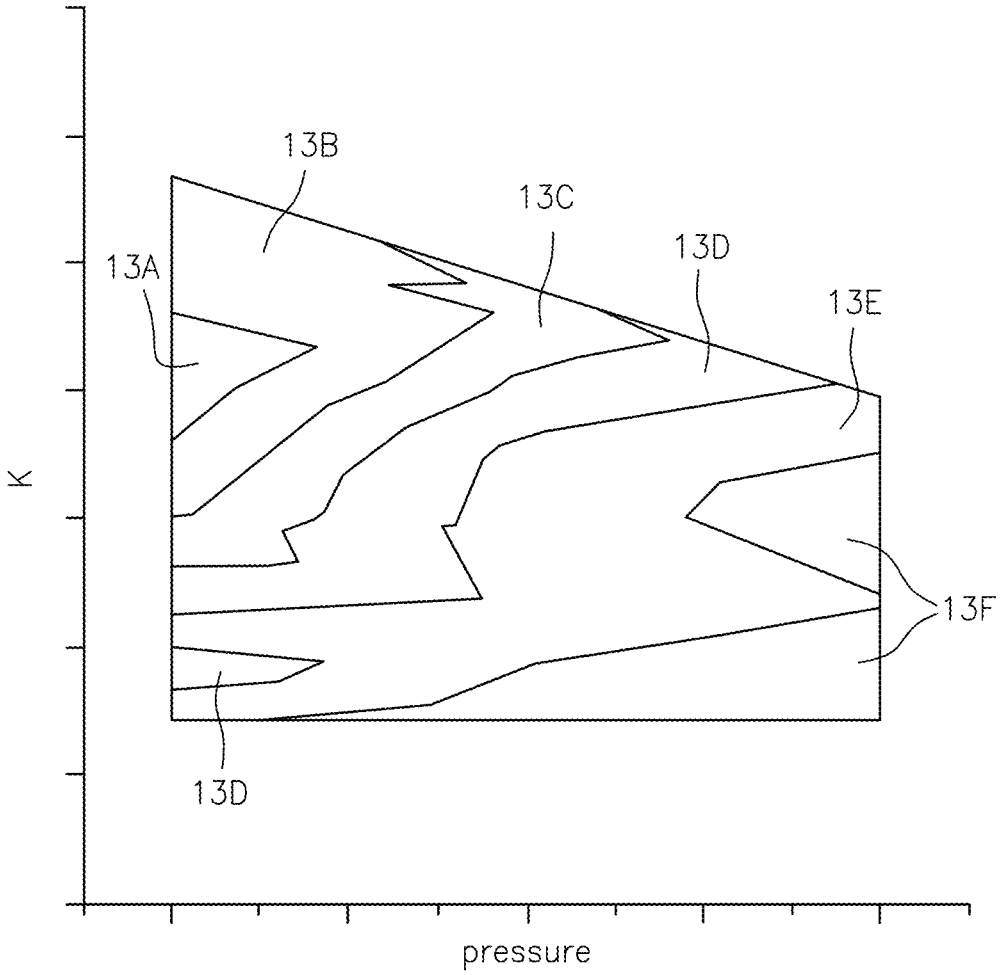
FIG. 13 is a graph showing drop size under K factor and pressure conditions.

FIG. 13 shows drop size ranges 13A, 13B, 13C, 13D, 13E, and 13F in relation to K factor and pressure for an embodiment of an LATD system. Drop size range 13A contains the largest drop sizes, which progressively decrease in size in drop size ranges 13B, 13C, 13D, 13E, and 13F, with drop size range 13F containing the smallest drop sizes.

Figure 14:
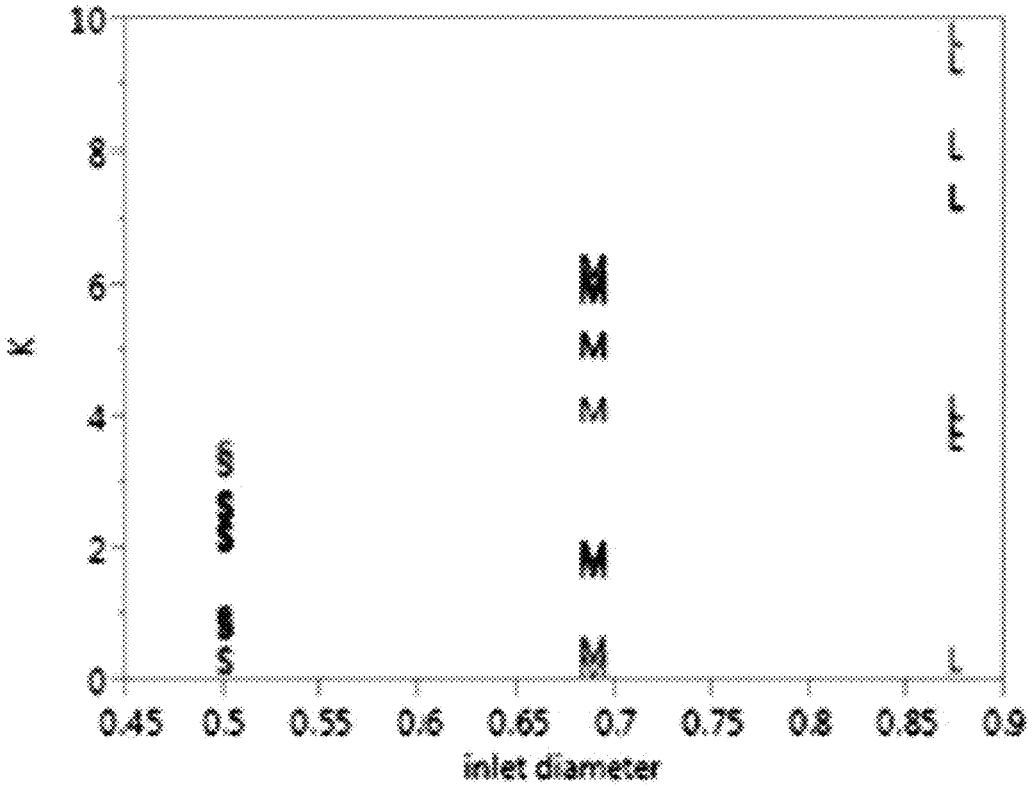
FIG. 14 is a graph showing K factors achieved at certain inlet diameters.

FIG. 14 is a graph showing K factors achieved in embodiments having certain inlet diameters. Inlet diameters of 0.5", 0.6875", and 0.875" were tested at flows ranging from 4-147 gpm. As shown in FIG. 14, the 0.5" diameter inlet produced comparatively small (S) K factors, the 0.6875" diamter inlet produced comparatively medium (M) K factors, and the 0.875" diameter inlet produced comparatively large (L) K factors. A 0.25" inlet diameter was also tested (not shown), which achieved a K factor range of 0.13 to 5.9.

As may be recognized by those of ordinary skill in the pertinent art based on the teachings herein, numerous changes and modifications may be made to the above-described and other embodiments without departing from the spirit and/or scope of the invention. Accordingly, this detailed description of embodiments is to be taken in an illustrative as opposed to a limiting sense.

What is claimed is:

1. A spray nozzle for emitting therefrom a spray pattern of liquid droplets, wherein a liquid flow is supplied to the spray nozzle from a liquid supply line at a liquid supply pressure, the liquid supply pressure is subject to changes, and the spray nozzle is configured to control a size of the liquid droplets, the spray nozzle comprising:

a hollow body having an upstream end and a downstream end and a liquid inlet in fluid communication with the hollow body and connectable in fluid communication with the liquid supply line, wherein the liquid inlet receives the liquid flow from the supply line and introduces the liquid flow into the hollow body where the liquid flows in a downstream direction toward the downstream end;

a nozzle portion located at the downstream end of the hollow body, the nozzle portion including a nozzle body defining an opening therethrough, and a stem having at least a portion located within the opening of the nozzle body, wherein one or more of the stem or nozzle body is movable axially or linearly relative to the other during said liquid flow so that, within a range of relative movement between the stem and the nozzle body, the nozzle body and the stem define a gap therebetween in fluid communication with the hollow body, wherein the gap receives the liquid flow from the hollow body and directs said liquid flow through the gap between the stem and nozzle body and out of the downstream end in the spray pattern of liquid droplets; and a motor operatively connected to at least one of the stem or nozzle body, wherein the motor is configured to drive the relative axial or linear movement of the stem and nozzle body during said liquid flow and within said range of relative movement and said stem and nozzle body are not rotatably driven, wherein said changes in liquid supply pressure do not change said relative position of the stem and nozzle body within said range of relative axial or linear movement, and the motor driving said relative axial or linear movement of the stem and nozzle body during said liquid flow controls a size of said gap independently of said changes in the liquid supply pressure to thereby control the size of the liquid droplets in the spray pattern.

2. A spray nozzle as defined in claim 1, wherein geometries of said nozzle body and said stem define said gap so that at each relative position of the stem and nozzle body within said range of relative movement, a flow area defined between the stem and the nozzle body does not increase in the downstream direction along said gap.

3. A spray nozzle as defined in claim 2, wherein said flow area decreases in the downstream direction along said gap.

4. A spray nozzle as defined in claim 2, wherein said flow area defined between the stem and the nozzle body defines a circular profile.

5. A spray nozzle as defined in claim 2, wherein, when the nozzle body and the stem are within said range of relative movement, said flow area between the nozzle body and the stem at a downstream end of said gap is less than said flow area between the nozzle body and the stem at an upstream end of said gap.

6. A spray nozzle as defined in claim 1, wherein a radius of curvature of the stem is greater than a radius of curvature of the nozzle body.

7. A spray nozzle as defined in claim 6, wherein the radius of curvature of the stem is at least twice the radius of curvature of the nozzle body.

8. A spray nozzle as defined in claim 6, wherein the radius of curvature of the stem and the radius of curvature of the nozzle body define a convergence point.

9. A spray nozzle as defined in claim 1, further comprising a rod operatively connected to one or more of the stem or nozzle body and movable axially or linearly to control said relative movement of the stem and nozzle body, wherein said rod includes a slot therein that extends at an angle relative to said direction of movement of the rod, a direction of movement of the stem is at an angle relative to the slot, and the stem includes a portion engaging and slidable along said slot, wherein movement of said rod moves the slot such that the slot engages the portion of the stem and moves the stem.

10. A spray nozzle as defined in claim 9, wherein said angle of the direction of said relative movement is about 90 degrees.

11. A spray nozzle as defined in claim 1, wherein, at a downstream end of said gap, the nozzle body and the stem define an angle relative to each other of about 5 degrees to about 10 degrees.

12. A spray nozzle as defined in claim 1, wherein the stem is a pintle.

13. A spray nozzle as defined in claim 1, wherein the motor is operatively connected to the stem and configured to control axial or linear movement of the stem relative to the nozzle body for preventing said changes in the liquid supply pressure from changing said relative position of the stem and nozzle body within said range of relative movement, and for controlling the size of said gap during said liquid flow and independently of said changes in the liquid supply pressure.

14. A spray nozzle as defined in claim 1, further comprising a rod operatively connected between the motor and the stem, and configured to move axially or linearly relative to the hollow body to control movement of the stem relative to the nozzle body, prevent said changes in fluid pressure from changing said relative position of the stem and nozzle body within said range of relative movement, and control the size of said gap during said liquid flow and independently of said changes in the liquid supply pressure.

15. A spray nozzle as defined in claim 1, further comprising a movable drive member operatively connected between the motor and the stem and configured to move the stem axially or linearly relative to the nozzle body, prevent said changes in fluid pressure from changing the relative position of the stem and nozzle body within said range of relative movement, and control said relative movement of the stem and nozzle body independently of said changes in the liquid supply pressure.

16. A spray nozzle as defined in claim 15, wherein the movable drive member is a rod defining an upstream end and a downstream end, the upstream end is drivingly mounted on the hollow body and the downstream end is drivingly connected to an upstream end of the stem for preventing said changes in fluid pressure from changing the relative position of the stem and nozzle body within said range of relative movement and controlling said relative movement of the stem and nozzle body and the size of said gap during said liquid flow and independently of said changes in the liquid supply pressure.

17. A spray nozzle as defined in claim 16, wherein the hollow body includes a mount located upstream of the stem and the motor is mounted thereto, the upstream end of the rod is drivingly mounted adjacent to the mount and is drivingly connected to the motor for preventing said changes in the liquid supply pressure from changing the relative position of the stem and nozzle body within said range of relative movement and controlling said relative movement of the stem and nozzle body and the size of said gap during said liquid flow and independently of said changes in the liquid supply pressure.

18. A spray nozzle as defined in claim 15, wherein the movable drive member is a rod configured to be driven axially or linearly relative to the nozzle body and the rod and stem are restrained from rotating relative to the nozzle body.

19. A spray nozzle as defined in claim 1, wherein the stem is configured to move axially or linearly relative to the nozzle body and is restrained from rotating relative to the nozzle body.

20. A spray nozzle as defined in claim 15, further comprising a non-resilient mount drivingly mounting an upstream end of the movable drive member on the hollow body.

21. A spray nozzle as defined in claim 15, wherein the gap is defined by the opening in the nozzle body and extends annularly about the stem between the stem and the nozzle body.

22. A spray nozzle as defined in claim 1, in combination with at least one of a pump or control valve, and a liquid supply line, wherein the pump or control valve is configured to flow the liquid through the liquid supply line at the liquid supply pressure and into the liquid inlet.

23. A combination as defined in claim 22, further comprising at least one controller operatively connected to (i) the motor and configured to control the motor to drive the relative axial or linear movement of the stem and nozzle body during said liquid flow and within said range of relative movement, and (ii) at least one of the pump to control a speed of the pump and the liquid supply pressure, or the control valve to control a setting or positon of the control valve to control the liquid supply pressure.

24. A combination as defined in claim 23, wherein the at least one controller is configured to (i) drive the motor to decrease the size of said gap and correspondingly decrease the speed of the pump to decrease the liquid supply pressure and substantially maintain the size of the liquid droplets, or (ii) drive the motor to increase the size of said gap and correspondingly increase the speed of the pump to increase the liquid supply pressure and substantially maintain the size of the liquid droplets.

25. A spray nozzle as defined in claim 1, wherein the motor is a stepper motor, a linear actuator, a pneumatic cylinder, or a servo actuator.

26. A spray nozzle for emitting therefrom a spray pattern of liquid droplets, wherein a liquid flow is supplied to the spray nozzle from a liquid supply line at a liquid supply pressure, the liquid supply pressure is subject to changes, and the spray nozzle is configured to control a size of the liquid droplets, the spray nozzle comprising:

first means having an upstream end and a downstream end and for directing said liquid flow in a downstream direction toward the downstream end, wherein the first means includes a liquid inlet connectable in fluid communication with the liquid supply line, and the liquid inlet receives the liquid flow from the liquid supply line and introduces the liquid flow into the first means where the liquid flows in the downstream direction;

a nozzle portion located at the downstream end of the first means, the nozzle portion including (i) a nozzle body defining an opening therethrough, and (ii) second means including at least a portion thereof located within the opening of the nozzle body for defining a gap therebetween in fluid communication with the first means, wherein the gap receives the liquid flow from the first means and directs said liquid flow through the gap between the nozzle body and the second means and out of the downstream end in the spray pattern of liquid droplets, wherein at least one of the second means or nozzle body is movable axially or linearly relative to the other during said liquid flow within a range of said relative movement between the second means and the nozzle body; and third means operatively connected to at least one of the nozzle body or the second means for driving the relative axial or linear movement of the nozzle body and the second means during said liquid flow and within said range of relative movement and wherein the nozzle body and second means are not rotatably driven, for preventing said changes in the liquid supply pressure from changing the relative position of the second means and nozzle body within said range of relative axial or linear movement and for controlling said relative axial or linear movement of the second means and nozzle body during said liquid flow and independently of said changes in the liquid supply pressure for controlling a size of said gap and the size of the liquid droplets in the spray pattern.

27. A spray nozzle as defined in claim 26, wherein the first means is a hollow body, the second means is a stem or pintle, and the third means is a motor and rod operatively connected to one or more of the stem or pintle such that the rod prevents said changes in liquid supply pressure from changing the position of the stem or pintle relative to the nozzle body within said range of relative movement and the motor controls said relative movement during said liquid flow and independently of said changes in the liquid supply pressure.

28. A spray nozzle as defined in claim 26, wherein said nozzle body and second means define said gap in the opening, the gap extends annularly about the second means, and at each relative position of the nozzle body and second means within said range of relative movement, a liquid flow area defined by said gap does not increase in the downstream direction along said gap.

29. A spray nozzle as defined in claim 26, wherein the second means is movable axially or linearly relative to the nozzle body, and the gap is defined in the opening and extends annularly about the second means.

30. A spray nozzle as defined in claim 26, in combination with a liquid supply line and fourth means for controlling the liquid supply pressure within the liquid supply line, and further comprising fifth means operatively connected to (i) the third means for controlling the third means to drive the relative axial or linear movement of the second means and nozzle body during said liquid flow and within said range of relative movement, and (ii) the fourth means for controlling the fourth means to control the liquid supply pressure within the liquid supply line.

31. A method for emitting a spray pattern of liquid droplets from a spray nozzle, wherein a liquid flow is supplied to the spray nozzle from a liquid supply line at a liquid supply pressure, the liquid supply pressure is subject to changes, and the method controls a size of the liquid droplets, the method comprising:

flowing the liquid into the spray nozzle, wherein the spray nozzle comprises a hollow body having an upstream end and a downstream end and a liquid inlet in fluid communication with the hollow body and connectable in fluid communication with the liquid supply line, wherein the flowing step includes receiving the liquid flow from the supply line through the liquid inlet and into the hollow body where the liquid flows in a downstream direction toward the downstream end;

a nozzle portion located at the downstream end of the body, the nozzle portion including a nozzle body defining an opening therethrough, and a stem having at least a portion located within the opening of the nozzle body, wherein one or more of the stem or nozzle body is movable axially or linearly relative to the other so that, within a range of relative axial or linear movement between the stem and the nozzle body, the nozzle body and the stem define a gap therebetween in fluid communication with the hollow body, wherein the flowing step includes receiving the liquid flow into the gap between the stem and nozzle body; and a motor operatively connected to at least one of the stem or nozzle body, wherein the motor is configured to drive the relative axial or linear movement of the stem and nozzle body during said liquid flow within said range of relative movement and said stem and nozzle body are not rotatably driven;

spraying the liquid through the gap between the stem and nozzle body and out of the downstream end in the spray pattern of liquid droplets; and controlling the size of said gap independently of said changes in the liquid supply pressure by operating the motor to drive one or more of the nozzle body or the stem axially or linearly relative to the other, but not rotatably drive the stem or nozzle body, from a first position within said range to a second position within said range during said liquid flow to thereby control the size of the liquid droplets in the spray pattern.

32. A method as defined in claim 31, further comprising spraying the liquid out of the nozzle in a spray pattern of atomized liquid droplets, and substantially maintaining droplet size of said spray in the first and second positions, wherein the controlling step includes (i) decreasing a size of said gap, and the substantially maintaining step includes decreasing the liquid supply pressure of the liquid flowing into the spray nozzle; or (ii) increasing a size of said gap, and the substantially maintaining step includes increasing the liquid supply pressure of the liquid flowing into the spray nozzle.

* * * * *